US010345005B2

(12) United States Patent
Giladi

(10) Patent No.: US 10,345,005 B2
(45) Date of Patent: Jul. 9, 2019

(54) BOILER

(71) Applicant: Dror Giladi, Ganey Tikva (IL)

(72) Inventor: Dror Giladi, Ganey Tikva (IL)

( * ) Notice: Subject to any disclaimer, the term of this patent is extended or adjusted under 35 U.S.C. 154(b) by 145 days.

(21) Appl. No.: 15/594,608

(22) Filed: May 14, 2017

(65) Prior Publication Data

US 2018/0328623 A1 Nov. 15, 2018

(51) Int. Cl.

| | |
|---|---|
| ***F24H 1/20*** | (2006.01) |
| ***F24H 7/00*** | (2006.01) |
| ***F24H 1/18*** | (2006.01) |
| ***H05B 3/60*** | (2006.01) |
| ***F22B 1/28*** | (2006.01) |
| ***H05B 3/03*** | (2006.01) |
| *F22B 1/30* | (2006.01) |

(52) U.S. Cl.

CPC ..... *F24H 7/002* (2013.01); *F22B 1/28* (2013.01); *F22B 1/284* (2013.01); *F24H 1/185* (2013.01); *F24H 1/203* (2013.01); *H05B 3/03* (2013.01); *H05B 3/60* (2013.01); *F22B 1/30* (2013.01); *F24H 2250/10* (2013.01); *H05B 2203/021* (2013.01)

(58) Field of Classification Search

CPC ..... F24H 7/002; F24H 2250/10; F24H 1/185; F24H 1/203; F22B 1/28; F22B 1/30; F22B 1/284; H05B 3/03; H05B 3/023; H05B 3/60; H05B 3/0004; H05B 2203/021

USPC ..... 392/318, 322, 338

See application file for complete search history.

(56) References Cited

U.S. PATENT DOCUMENTS

| | | | | |
|---|---|---|---|---|
| 3,144,546 | A | 8/1964 | Foley et al. | |
| 3,937,920 | A * | 2/1976 | Gundacker | F22B 1/30 392/327 |
| 4,036,716 | A * | 7/1977 | Hulthe | C02F 1/46104 205/729 |
| 4,343,987 | A * | 8/1982 | Schimbke | F22B 1/30 122/382 |
| 2009/0074389 | A1* | 3/2009 | Noe | F24H 1/106 392/314 |
| 2012/0061378 | A1* | 3/2012 | Colburn | A47J 27/04 219/486 |

OTHER PUBLICATIONS

Electric Heating, Wikipedia, https://en.wikipedia.org/wiki/electric_heating, downloaded Apr. 27, 2017.

Switched Capacitor, Wikipedia, https://en.wikipedia.org/wiki/switched_capacitor, downloaded Apr. 27, 2017.

* cited by examiner

*Primary Examiner* — Matthew W Jellett

(74) *Attorney, Agent, or Firm* — Alphapatent Associates, Ltd; Daniel J. Swirsky

(57) ABSTRACT

A boiler, including: electrodes immersed in contained water, for heating thereof; and a separating circuit, for supplying electric power from an electric grid supply to the electrodes therethrough in an electric separated manner, thereby the water electrified by the electrodes is electrically separated from the electric grid supply, thereby providing safety.

9 Claims, 5 Drawing Sheets

FIG 2 - PRIOR ART

BOILER

TECHNICAL FIELD

The invention relates to the field of boilers for residential water heating. More particularly, the invention relates to an electrode boiler.

BACKGROUND

U.S. Pat. No. 3,144,546 discloses water heating via electrodes. U.S. Pat. No. 3,144,546, describes the electric circuit thereof as follows:

> Preferably two separate electrodes are used, each connected to a separate lead of a three-wire electric current supply system such as is commonly used with 220-volt house wiring circuits. When a three-wire 220-volt circuit is used, it is preferred that the housing be connected to a lead, usually called the ground wire, so that there is a potential of volts between the housing and each of the electrodes and a potential of 220 volts between the electrode.

However, water heating by electrodes practically is not used for residential boilers, for supplying the water thereof for washing, since being regarded not safe. For instance, https://en.wikipedia.org/wiki/Electric_heating describes the following: "Electrode heater: With an electrode heater, there is no wire-wound resistance and the liquid itself acts as the resistance. This has potential hazards, so the regulations governing electrode heaters are strict."

The reason for the potential hazards may be explained according to U.S. Pat. No. 3,144,546, describing the electric circuit thereof (mentioned above).

FIG. 1 depicts the electric circuit of the prior art electrode heating.

Electrodes 18 and 20 are immersed in the water. The electric grid supply 26 is connected to electrodes 18 and 20.

FIG. 2 depicts the problem of the prior art electric circuit.

According to U.S. Pat. No. 3,144,546, the contained water is electrified by the 220 volts potential of electric grid supply 26, and carries it to the ground 24, and during washing, the current flows through human user 36. This produces an electric leak, and thus, the residual-current device, does not allow this electric flow, and cuts off the current.

SUMMARY

In one aspect of the invention, the invention provides a safe electrode boiler.

In one aspect of the invention, the invention provides a solution to the above-mentioned and other problems of the prior art.

In one aspect, the invention is directed to a boiler (10), including:

- electrodes immersed in contained water, for heating thereof; and
- a separating circuit, for supplying electric power from an electric grid supply to the electrodes therethrough in an electric separated manner,
- thereby the water electrified by the electrodes is electrically separated from the electric grid supply,
- thereby providing safety.

BRIEF DESCRIPTION OF THE DRAWINGS

Embodiments, features, and aspects of the invention are described herein in conjunction with the following drawing figures.

The drawings are not necessarily drawn to scale.

DETAILED DESCRIPTION

The invention will be understood from the following detailed description of embodiments of the invention, which are meant to be descriptive and not limiting. For the sake of brevity, some well-known features, methods, systems, procedures, components, circuits, and so on, are not described in detail.

The reference numbers have been used to point out elements in the embodiments described and illustrated herein, in order to facilitate the understanding of the invention. They are meant to be merely illustrative, and not limiting. Also, the foregoing embodiments of the invention have been described and illustrated in conjunction with systems and methods thereof, which are meant to be merely illustrative, and not limiting.

Figure 1:
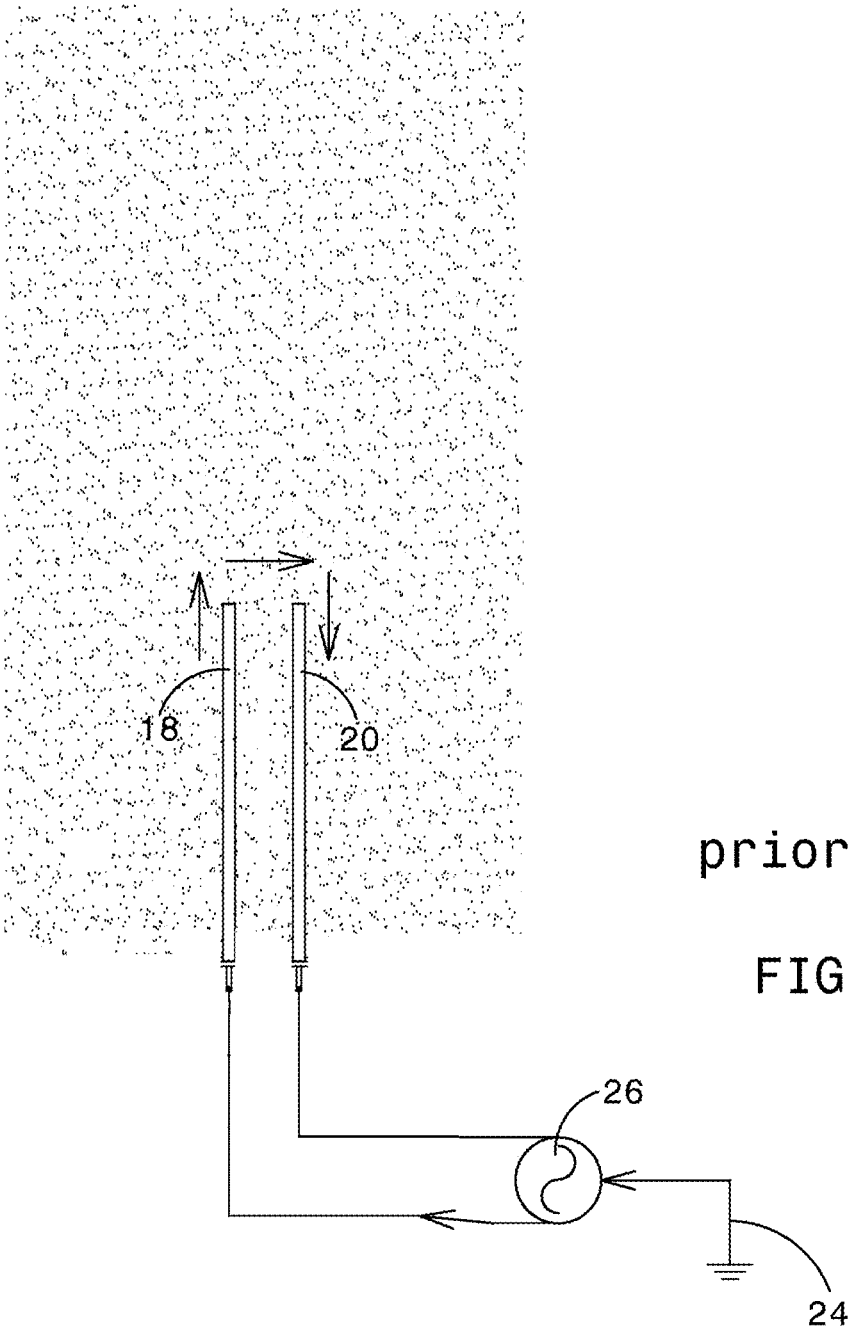
prior art FIG 1
FIG. 1 depicts the electric circuit of the prior art electrode heating.
Figure 2:
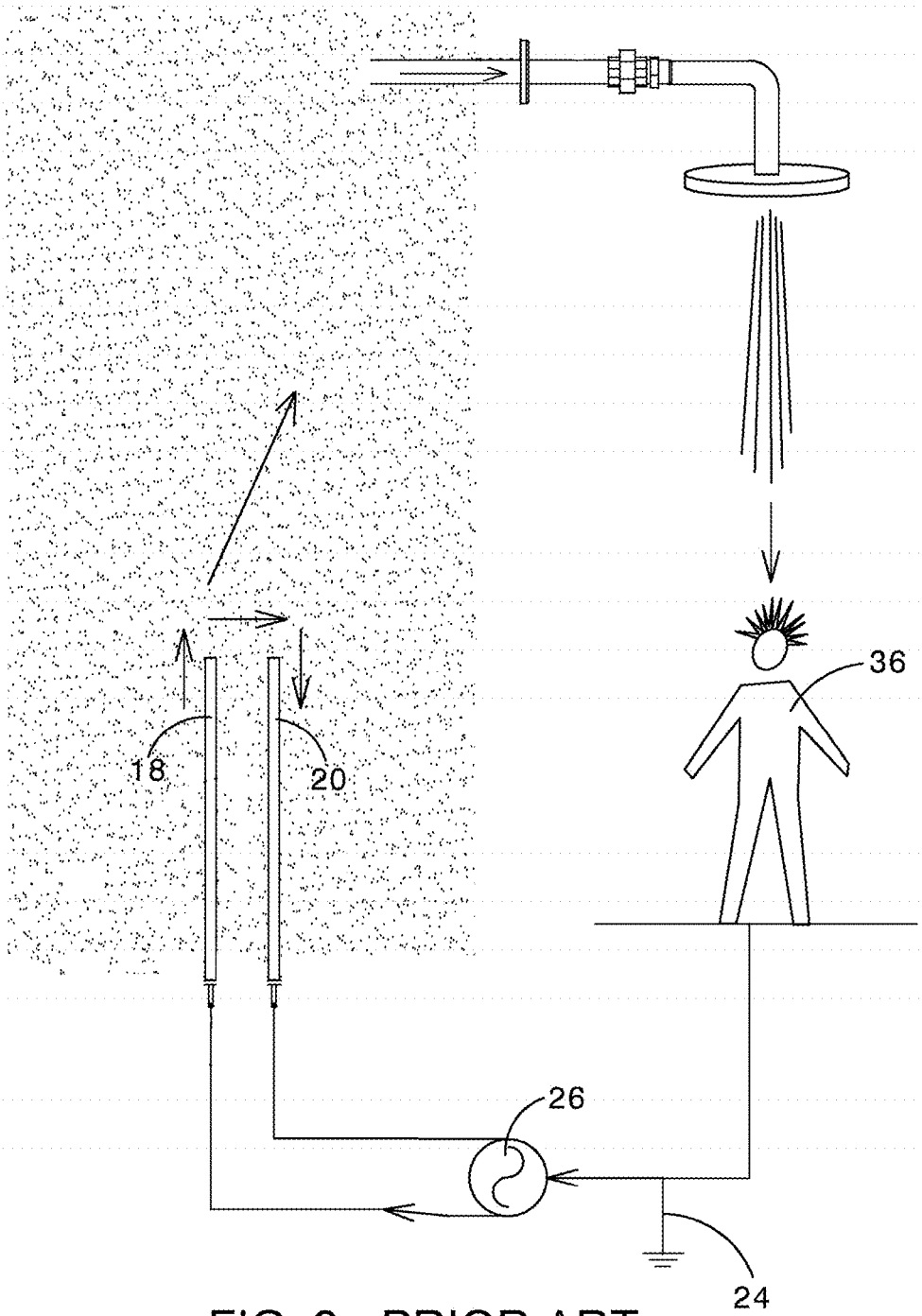
FIG. 2 depicts the problem of the prior art electric circuit.
Figure 3:
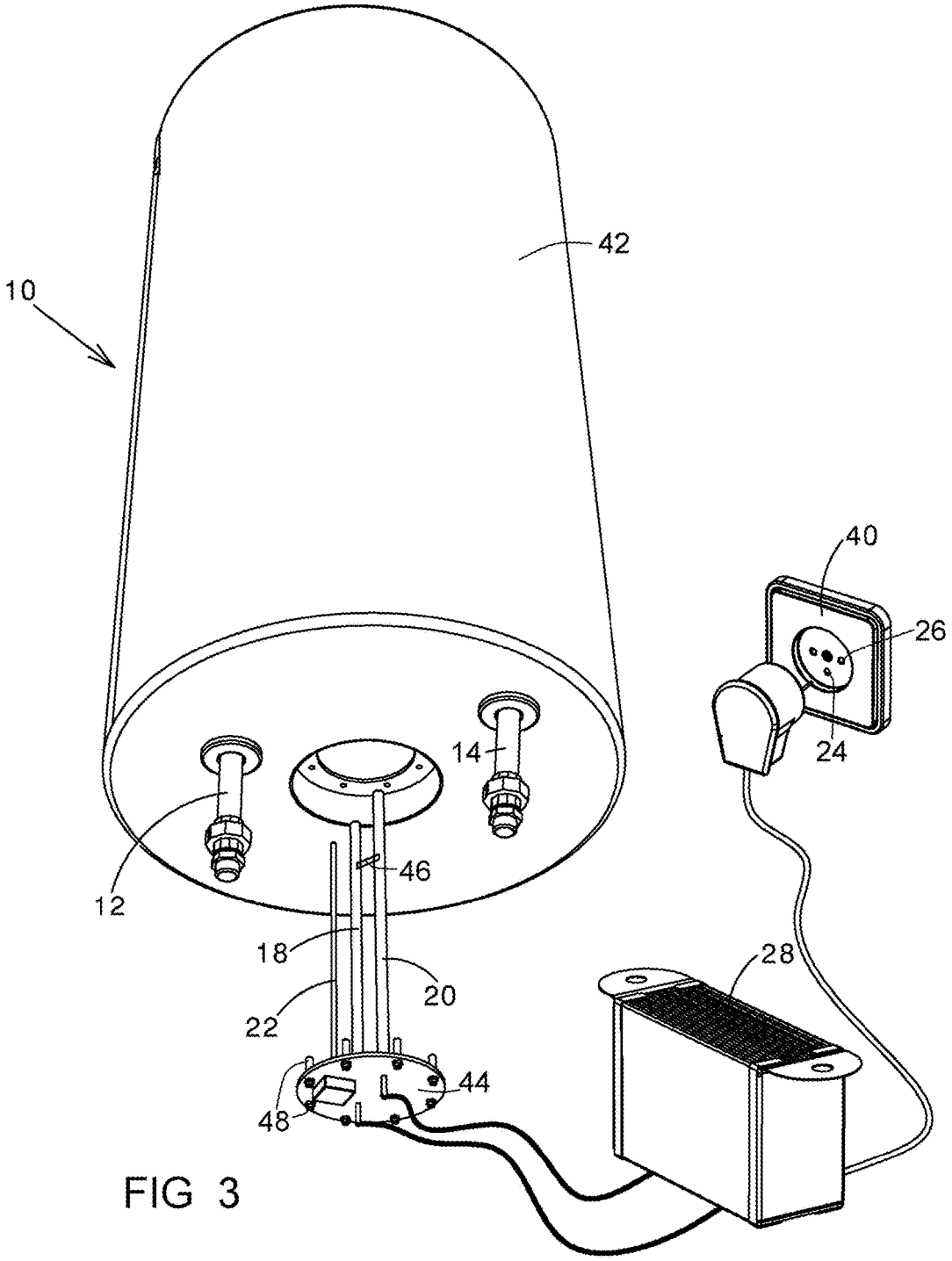
FIG. 3 is a perspective view of a boiler according to one embodiment of the invention.

FIG. 3 is a perspective view of a boiler according to one embodiment of the invention.

The term "boiler" refers herein to a kettle, residential boiler for washing, for residential or commercial kitchen water heating accessory, to any heating accessory for heating any water container, such as for a swimming pool, washing machine, hot tub, etc.

In boiler 10, the flange 44 includes electrodes 18 and 20 instead of a heating element. Electrodes 18 and 20 are electrically insulated from flange 44, for not allowing direct electric flow therebetween through flange 44. Flange 44 further includes a thermostat 22.

Upon fixing flange 44 to boiler tank 42 in a standard manner, being by bolts 48, electrodes 18 and 20 are immersed in the water 16, contained by the boiler tank 42.

In contrast to the heating element, which produces self heating, and consequently heats any substance being in physical contact therewith, and thus heats flange 44 to a very high temperature, e.g., 250 deg C., thus melting flange 44 is being of plastic, electrodes 18 and 20 do not heat themselves, but rather heat the water. Thus, the temperature of flange 44 does not exceed 80 deg C.

Thus, the material of flange 44 may be of plastic, being a non-electric-conductive material. Thus, boiler tank 42 as well may be made of plastic.

Thus, the body of boiler tank 42 and of flange 44 need not be grounded.

The bottom of electrodes 18 and 20 is physically fixed to flange 44, thus determining a certain distance therebetween, thus providing a certain electric current therebetween through the water.

In case that flange 44 is not too rigid, such as if made of plastic, a rod 46 may determine a certain distance between the top of electrodes 18 and 20 at the side thereof being deep in the water. Rod 46 must be of an electric insulating material.

Electrodes 18 and 20 receive the electric current supply not directly from electric grid supply 26, but rather from a transformer 28, being powered by electric grid supply 26.

Figure 4:
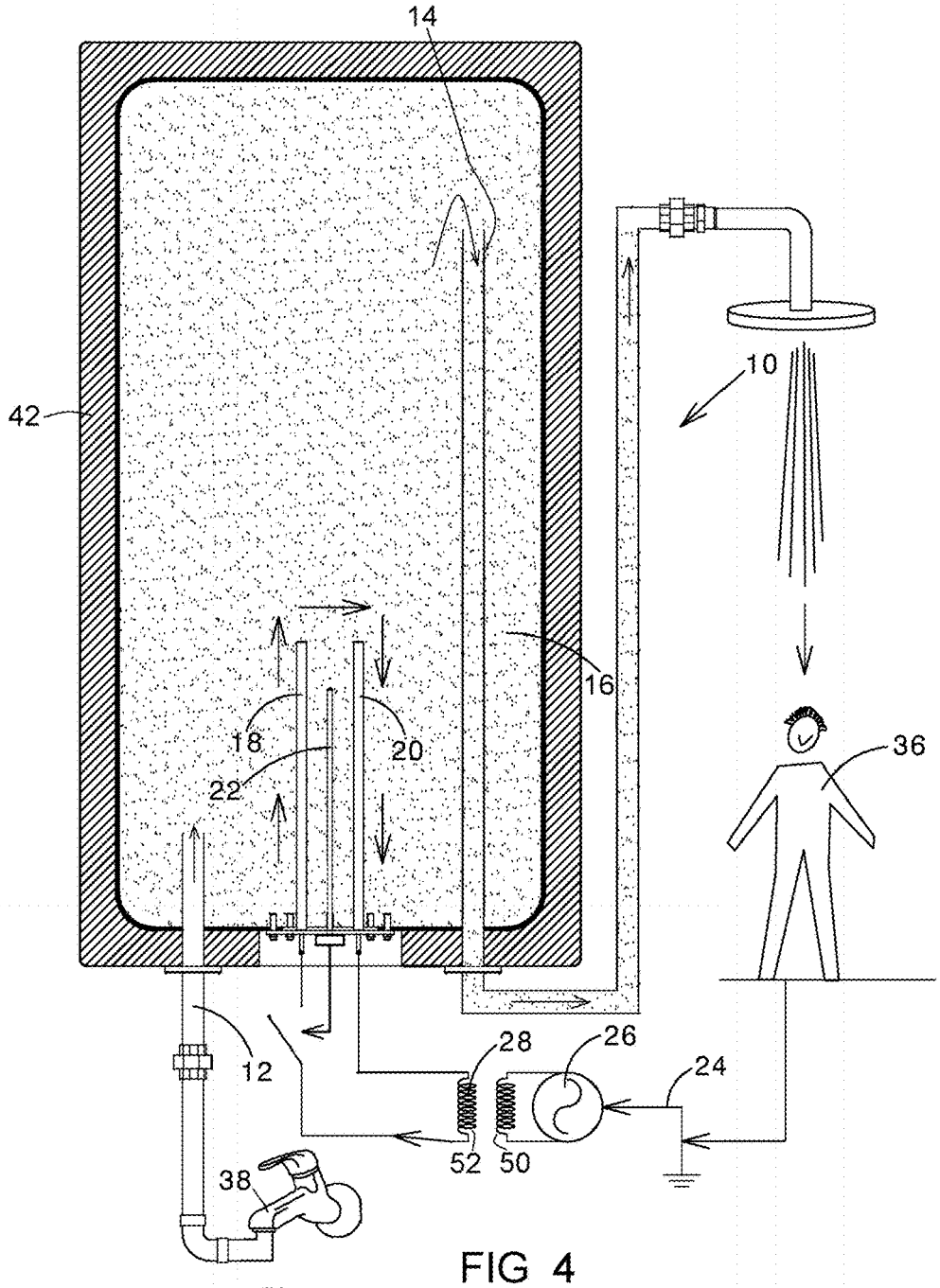
FIG. 4 is a sectional view of the boiler of FIG. 3, including the electric circuit.

FIG. 4 is a sectional view of the boiler of FIG. 3, including the electric circuit for the embodiment of FIG. 3.

Electrodes 18 and 20 are immersed in the water 16. The electric grid supply 26 is connected to primary winding 50 of transformer 28. Secondary winding 52 of transformer 28 is connected to electrodes 18 and 20.

In this configuration, there is no hazard that the contained water 16 carries 220 volts potential, since it is supplied by secondary winding 52 of transformer 28 and not by electric grid supply 26.

Thus, it does not produce an electric leak, and thus, the residual-current device, should not cut off the current supply.

Thus, boiler 10 does not require grounding.

Transformer 28 need not change the voltage. For example both the primary and the secondary windings may carry 220 volt.

Transformer 28 may constitute a magnetic transformer described above, or an electronic transformer, being a switchmode power supply.

Figure 5:
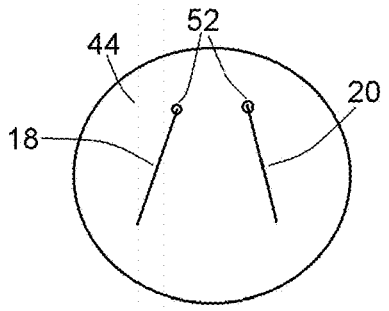
FIG. 5 is a top view of the flange and electrodes of FIG. 3, according to another embodiment.

FIG. 5 is a top view of the flange and electrodes of FIG. 3, according to one embodiment.

The closer electrodes 18 and 20 are displaced one from the other, the larger is the heating power and consumption is.

Electrodes 18 and 20 may constitute plates, and rotation thereof about hinges 52 may change the integrated distance. The installer may determine the disposition of electrodes 18 and 20 for determining the heating power.

Figure 6:
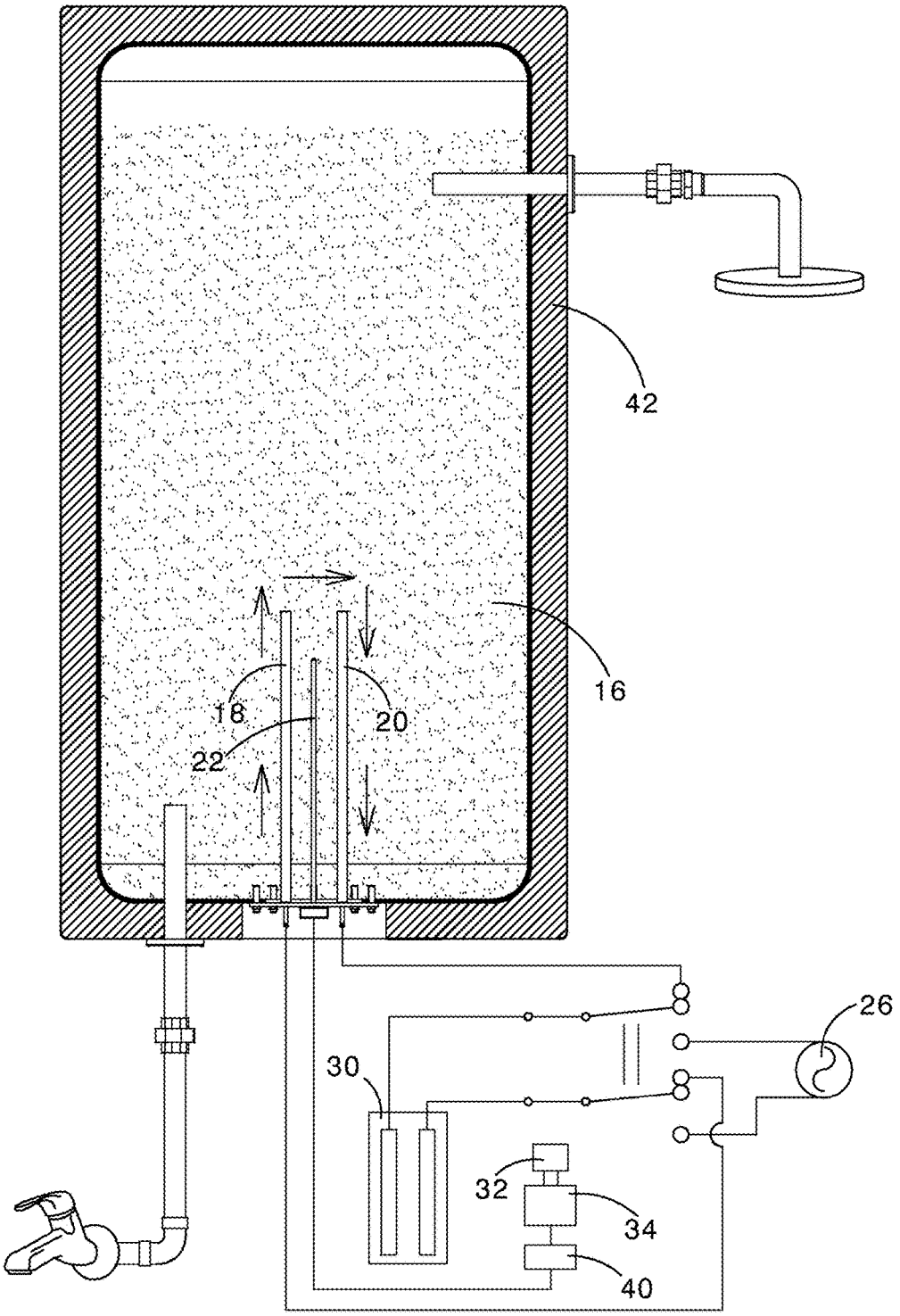
FIG. 6 depicts the boiler of FIG. 3, including a different electric circuit for supplying electric power.

FIG. 6 depicts the boiler of FIG. 3, including a different electric circuit for supplying the electric power.

According to another embodiment, a capacitor 30, instead of the transformer of FIGS. 3 and 4 may provide the separation of electrodes 18 and 20 from the electric grid supply 26.

At the first step, a capacitor 30 is connected to the electric grid supply 26, for charging it therefrom.

At the second step, capacitor 30 is disconnected from the electric grid supply 26.

At the third step capacitor 30 is connected to electrodes 18 and 20, for discharging capacitor 30 for supplying the stored electric power thereto.

At the second step, capacitor 30 is disconnected from electrodes 18 and 20.

The above four steps are repeated as long as thermostat 22 demands electric power.

In the above procedure electrodes 18 and 20 are strictly disconnected from electrodes 18 and 20, and thus the body of boiler tank 42 and of flange 44 need not be grounded.

A double pole relay 32, controlled by a timer 34, may operate the above-mentioned steps.

Also in this configuration, there is no hazard that the contained water 16 carries 220 volts potential, since the power is supplied by capacitor 30 and not by electric grid supply 26.

The amount of the supplied power is controllable by timer 34. The longer period capacitor 30 is disconnected or does not charge or discharge the power thereof, the smaller is the amount of the power supplied thereby. Thus, in contrast to a conventional heating element having a constant heating level, timer 34 may dynamically adjust the heating level, according to an input of adjusting element 40.

Adjusting element 40 may receive the input of thermostat 22.

Thus, in one aspect, the invention is directed to a boiler (10), including:

electrodes (18, 20) immersed in contained water (16), for heating thereof; and a separating circuit (28, 30), for supplying electric power from an electric grid supply (26) to the electrodes (18, 20) therethrough in an electric separated manner, thereby the water (16), being electrified by the electrodes (18, 20) is electrically separated from the electric grid supply (26), thereby providing safety.

The separating circuit (28, 30) may include a transformer (28).

The primary winding (50) of the transformer (28) is connected to the electric grid supply (26), and the secondary winding (52) of the transformer (28) is connected to the electrodes (28, 18, 20).

The separating circuit (28, 30) may include a capacitor (30).

The separating circuit (28, 30) according to this embodiment includes a double pole connection (32), for connecting the capacitor (30) to the electric grid supply (26) only, and then for connecting the capacitor (30) to the electrodes (18, 20) only.

The separating circuit (28, 30) may further include a timer (34), for automatically controlling the double pole connection (32), for connecting the capacitor (30) to the electric grid supply (26) only, and then for connecting the capacitor (30) to the electrodes (18, 20) only.

The separating circuit (28, 30) may further include an adjusting element (40), for automatically controlling the double pole connection (32), for adjusting periods the capacitor (30) supplies electric power to the electrodes (18, 20) in relation to periods the capacitor (30) does not supply electric power to the electrodes (18, 20), thereby dynamically adjusting power supplied to the electrodes (18, 20).

The electrodes (18, 20) may be fixed to a flange (44), being removable from a tank (42) of the boiler (10), thereby allowing replacing the flange (44), for replacing a resistive heating element attached thereto, with the electrodes (18, 20).

The material of the flange (44) may be plastic.

The electrodes (18, 20) may be shaped as plates, for increasing surface area thereof, for increasing heating power thereof.

At least one of the electrodes (18, 20) may include a hinge (52), for rotating thereof, for adjusting the distance thereof from the other electrode.

The boiler (10) may further include:

means (46) for maintaining the distance between the electrodes (18, 20) deep in the contained water (16).

In another aspect, the invention is directed to a method for heating a boiler (10), including the steps of:

connecting a capacitor (30) to an electric grid supply (26) only, for charging the capacitor (30); and connecting the capacitor (30) to the electrodes (18, 20) only, for discharging the capacitor (30), for supplying electric power to the electrodes (18, 20).

The may further include the step of adjusting periods of the charging and discharging, for adjusting the heating level of the electrodes (18, 20).

In the figures and/or description herein, the following reference numerals (Reference Signs List) have been mentioned:

numeral 10 denotes the electrode boiler, according to one embodiment of the invention;

numeral 12 denotes the inlet pipe of the boiler;

numeral 14 denotes the outlet pipe of the boiler;

numeral 16 denotes the water contained by the boiler tank;
numerals 18 and 20 denotes the electrodes, for heating the contained water;
numeral 22 denotes a thermostat;
numeral 24 denotes ground/earth;
numeral 26 denotes the electric grid supply;
numeral 28 denotes a transformer, for electrically separating the electric grid supply from the electrodes;
numeral 30 denotes a capacitor, for storing and supplying electric power;
numeral 36 denotes the user;
numeral 38 denotes the water grid supply;
numeral 40 denotes a level heating adjuster;
numeral 42 denotes the tank of the boiler;
numeral 44 denotes the flange, to which the thermostat is connected; normally also the heating element is connected to the flange; according to the invention, the electrodes are connected to the flange instead of the heating element;
numeral 46 denotes a rod or other means, such as a spacer for maintaining a certain distance between the top of the electrodes;
numeral 48 denotes a bolt for connecting the flange to the boiler tank;
numeral 50 denotes the primary winding of the transformer; and
numeral 52 denotes the secondary winding of the transformer.

The foregoing description and illustrations of the embodiments of the invention has been presented for the purposes of illustration. It is not intended to be exhaustive or to limit the invention to the above description in any form.

Any term that has been defined above and used in the claims, should to be interpreted according to this definition.

The reference numbers in the claims are not a part of the claims, but rather used for facilitating the reading thereof. These reference numbers should not be interpreted as limiting the claims in any form.

What is claimed is:

1. A boiler, comprising:

electrodes immersed in contained water, for heating thereof; and a capacitor, for supplying electric power from an electric grid supply thereto for storing the electric power while said electrodes are disconnected from said capacitor, and for supplying said stored electric power from said capacitor to said electrodes while said electric grid supply is disconnected from said capacitor, thereby the water electrified by said electrodes is electrically separated from the electric grid supply, thereby providing safety.

2. A boiler according to claim 1, further comprising a double pole connection, for connecting said capacitor to the electric grid supply only, and then for connecting said capacitor to said electrodes only.

3. A boiler according to claim 2, further comprising a timer, for automatically controlling said double pole connection, for connecting said capacitor to the electric grid supply only, and then for connecting said capacitor to said electrodes only.

4. A boiler according to claim 2, further comprising an adjusting element, for automatically controlling said double pole connection, for adjusting periods said capacitor supplies electric power to said electrodes in relation to periods said capacitor does not supply electric power to said electrodes, thereby dynamically adjusting power supplied to said electrodes.

5. A boiler according to claim 1, wherein said electrodes are fixed to a flange, being removable from a tank of said boiler, thereby allowing replacing a flange, for replacing a resistive heating element attached thereto, with said electrodes.

6. A boiler according to claim 1, wherein a material of said flange is plastic.

7. A boiler according to claim 1, wherein said electrodes are shaped as plates, for increasing surface area thereof, for increasing heating power thereof.

8. A boiler according to claim 1, wherein at least one of said electrodes comprises a hinge, for rotating thereof, for adjusting a distance thereof from the other electrode.

9. A boiler according to claim 1, further comprising:

means for maintaining a distance between said electrodes deep in the contained water.

* * * * *